US007780855B2

(12) United States Patent
Eberly

(10) Patent No.: US 7,780,855 B2
(45) Date of Patent: Aug. 24, 2010

(54) METHOD FOR PRE-ENGINEERING A SYSTEM FOR ENVIRONMENTAL CONTROL OF STORM WATER

(76) Inventor: Christopher N. Eberly, 10353 Eberly Ranch Rd., Chappel Hill, TX (US) 77426

( * ) Notice: Subject to any disclaimer, the term of this patent is extended or adjusted under 35 U.S.C. 154(b) by 0 days.

(21) Appl. No.: 12/327,948

(22) Filed: Dec. 4, 2008

(65) Prior Publication Data

US 2009/0090664 A1 Apr. 9, 2009

Related U.S. Application Data

(63) Continuation of application No. 10/987,126, filed on Nov. 12, 2004, now Pat. No. 7,470,361.

(60) Provisional application No. 60/520,001, filed on Nov. 14, 2003.

(51) Int. Cl.
*C02F 1/00* (2006.01)

(52) U.S. Cl. ..... 210/747; 210/790; 210/800

(58) Field of Classification Search ..... 210/747, 210/800, 790

See application file for complete search history.

(56) References Cited

U.S. PATENT DOCUMENTS

| | | | |
|---|---|---|---|
| 236,740 | A | 1/1881 | Waring, Jr. |
| 325,231 | A | 9/1885 | Badgley |
| 942,907 | A | 12/1909 | Huff |
| 1,035,926 | A | 8/1912 | Wagner |
| 1,237,068 | A | 8/1917 | Loeb |
| 1,349,734 | A | 8/1920 | Riley |
| 1,778,326 | A | 10/1930 | Kutzer |
| 1,844,443 | A | 2/1932 | Schmidt |
| 1,903,774 | A | 4/1933 | Burrell |
| 2,136,945 | A | 11/1938 | Klein |
| 2,164,011 | A | 6/1939 | Hilborn |

(Continued)

FOREIGN PATENT DOCUMENTS

| | | | |
|---|---|---|---|
| EP | 011799 | A1 | 6/1984 |

(Continued)

OTHER PUBLICATIONS

Environment, U.S. Department of Transportation, Federal Highway Administration, Stormwater Best Management Practices in an Ultra-Urban Setting: Selection and Monitoring, [retrieved on Dec. 4, 2009], Retrieved from the Internet< URL: http://www.fhwa.dot.gov/environment/ultraurb/3fs14.htm>.*

*Primary Examiner*—Matthew O Savage
(74) *Attorney, Agent, or Firm*—Charles S. Knobloch; Arnold & Knobloch, L.L.P.

(57) ABSTRACT

The present invention provides a method of installing an environmental control system so as to allow for separate sizing of treatment and bypass capacity while also offering the ability to make or change either treatment or bypass capacities at different times. This is accomplished by containing the treatment and bypass functions in separate chambers, using screen, baffle, or coalescing media pack to further refine effectiveness and capacity of each structure independently. The control structure and interceptor structure may be pre-engineered to a variety of sizes, capacities, or other specifications. This allows simple selection of a specific control structure and a specific interceptor structure from a variety of combinations, eliminating the need for custom engineering for each installation.

1 Claim, 9 Drawing Sheets

U.S. PATENT DOCUMENTS

| | | | |
|---|---|---|---|
| 2,393,498 | A | 1/1946 | Miller |
| 2,764,545 | A | 9/1956 | Primich |
| 2,796,988 | A | 6/1957 | Loffler |
| 2,820,550 | A | 1/1958 | Sprg |
| 3,175,578 | A | 3/1965 | Patterson et al. |
| 3,221,881 | A | 12/1965 | Weiler et al. |
| 3,258,123 | A | 6/1966 | Fontaine |
| 3,282,436 | A | 11/1966 | Malm |
| 3,346,122 | A | 10/1967 | Cornelissen |
| 3,362,542 | A | 1/1968 | Stevens |
| 3,363,876 | A | 1/1968 | Moore |
| 3,374,894 | A | 3/1968 | Webster |
| 3,567,024 | A | 3/1971 | McCormick |
| 3,567,032 | A | 3/1971 | Kemper |
| 3,568,842 | A | 3/1971 | Bozek |
| 3,725,271 | A | 4/1973 | Giannotti |
| 3,837,501 | A | 9/1974 | Pielkenrood |
| 3,862,040 | A | 1/1975 | Preus et al. |
| 3,884,815 | A | 5/1975 | Cornelissen |
| 4,031,009 | A | 6/1977 | Hicks |
| 4,073,734 | A | 2/1978 | Lowrie |
| 4,103,862 | A | 8/1978 | Moore |
| 4,127,488 | A | 11/1978 | Bell et al. |
| 4,136,010 | A | 1/1979 | Pilie et al. |
| 4,261,823 | A | 4/1981 | Gallagher et al. |
| 4,297,219 | A | 10/1981 | Kirk et al. |
| 4,328,101 | A | 5/1982 | Broden |
| 4,363,731 | A | 12/1982 | Filippi |
| 4,405,458 | A | 9/1983 | McHugh |
| 4,455,231 | A | 6/1984 | Filippi |
| 4,526,691 | A | 7/1985 | Melis et al. |
| 4,578,188 | A | 3/1986 | Cousino |
| 4,684,467 | A | 8/1987 | Cloud |
| 4,722,800 | A | 2/1988 | Aymong |
| 4,778,494 | A | 10/1988 | Patterson |
| 4,897,206 | A | 1/1990 | Castelli |
| 4,898,678 | A | 2/1990 | Johnson |
| 4,985,148 | A | 1/1991 | Monteith |
| 5,052,442 | A | 10/1991 | Johannessen |
| 5,122,280 | A | 6/1992 | Russell et al. |
| 5,156,745 | A | 10/1992 | Cairo, Jr. et al. |
| 5,173,195 | A | 12/1992 | Wright et al. |
| 5,196,123 | A | 3/1993 | Guthy |
| 5,246,592 | A | 9/1993 | Schweizer et al. |
| 5,266,191 | A | 11/1993 | Green et al. |
| 5,303,782 | A | 4/1994 | Johannessen |
| 5,310,481 | A | 5/1994 | Rondano |
| 5,401,404 | A | 3/1995 | Strauss |
| 5,419,838 | A | 5/1995 | DiTullio |
| 5,433,845 | A | 7/1995 | Greene et al. |
| 5,498,331 | A | 3/1996 | Monteith |
| 5,500,132 | A | 3/1996 | Elmi |
| 5,505,860 | A | 4/1996 | Sager |
| 5,531,888 | A | 7/1996 | Geiger |
| 5,549,817 | A | 8/1996 | Horsley et al. |
| 5,560,826 | A | 10/1996 | Szereday et al. |
| 5,565,101 | A | 10/1996 | Kuntz |
| 5,725,760 | A | 3/1998 | Monteith |
| 5,746,911 | A | 5/1998 | Pank |
| 5,746,912 | A | 5/1998 | Monteith |
| 5,753,115 | A | 5/1998 | Monteith |
| 5,759,415 | A | 6/1998 | Adams |
| 5,779,888 | A | 7/1998 | Bennett |
| 5,788,848 | A | 8/1998 | Blanche et al. |
| 5,849,181 | A | 12/1998 | Monteith |
| 5,902,477 | A | 5/1999 | Vena |
| 5,946,967 | A | 9/1999 | Russell |
| 5,993,646 | A | 11/1999 | Powers |
| 6,053,206 | A | 4/2000 | Johannesen |
| 6,062,767 | A | 5/2000 | Kizhnerman et al. |
| 6,077,448 | A | 6/2000 | Tran-Quoc-Nam et al. |
| 6,080,305 | A | 6/2000 | Sandahl |
| 6,080,307 | A | 6/2000 | Morris et al. |
| 6,086,756 | A | 7/2000 | Roy |
| 6,126,817 | A | 10/2000 | Duran et al. |
| 6,190,545 | B1 | 2/2001 | Williamson |
| 6,241,881 | B1 | 6/2001 | Pezzaniti |
| 6,241,882 | B1 | 6/2001 | Allard |
| 6,264,835 | B1 | 7/2001 | Pank |
| 6,428,692 | B2 | 8/2002 | Happell |
| 6,475,381 | B1 | 11/2002 | Gustafsson |
| 6,524,473 | B2 | 2/2003 | Williamson |
| 6,638,424 | B2 * | 10/2003 | Stever et al. ..... 210/170.03 |
| 6,783,683 | B2 | 8/2004 | Collings |
| 2003/0000895 | A1 | 1/2003 | Hensley et al. |

FOREIGN PATENT DOCUMENTS

| | | | |
|---|---|---|---|
| EP | 0 561 170 | A1 | 9/1993 |
| EP | 0 739 858 | A2 | 10/1996 |
| FR | 2 626 782 | A1 | 8/1989 |
| FR | 2 682 945 | A1 | 4/1993 |
| JP | 63-12396 | A | 1/1988 |
| JP | 2-95492 | A | 4/1990 |
| JP | 4-83033 | A | 3/1992 |
| JP | 10-34188 | A | 2/1998 |
| JP | 11-57693 | A | 3/1999 |
| JP | 11-165183 | A | 6/1999 |
| JP | 2000-354712 | A | 12/2000 |
| WO | WO 92/03208 | A1 | 3/1992 |
| WO | WO 94/05601 | A1 | 3/1994 |
| WO | WO 96/06667 | A2 | 3/1996 |
| WO | WO 97/44219 | A1 | 11/1997 |
| WO | WO 97/46300 | A1 | 12/1997 |
| WO | WO 98/01395 | A1 | 1/1998 |
| WO | WO 99/58455 | A1 | 11/1999 |

* cited by examiner

METHOD FOR PRE-ENGINEERING A SYSTEM FOR ENVIRONMENTAL CONTROL OF STORM WATER

REFERENCE

This application is a continuation of application Ser. No. 10/987,126, filed Nov. 12, 2004, which claims the benefit of U.S. Provisional Application No. 60/520,001, filed Nov. 14, 2003.

FIELD OF THE INVENTION

The present invention relates generally to the environmental control of storm water and its associated contaminants.

BACKGROUND OF THE INVENTION

It is well known in the art that wastewater can be collected into a separator tank to remove debris. Separator tanks have long been used to separate oils from water. Generally, these debris or oils may be called contaminants.

The use of separator tanks poses two problems when used to treat waste water. One, high flow rates create turbulence. The turbulence diminishes the ability of separator tanks to separate the contaminants. The turbulence may also re-mobilize the already separated contaminants, placing the contaminants back into the waste water to be treated. To avoid these undesired effects, the separator tanks must be made significantly large to overcome the effects of turbulence. Second, the separator tanks must be made large enough to perform during peaks in flow. Peaks in flow mean higher flow rates, causing two effects which impact the total amount of contaminants contained in these flows. First, the high flow rate brings a higher volume of liquid and overall more contaminants. Second, the high flow rate has increased contaminant carrying capacity owing to the higher flow rate itself. These two factors, combined, would result in greater total contaminants being brought to the separator tank during peak flows. This phenomenon is particularly apparent with treatment of storm water runoff, where the initial storm water contains the bulk of the contaminants, being the "first flush" of the drainage area. However, there is a limit to the total amount of contaminants available. Even though the high flow rates are capable of carrying and remobilizing a greater amount of contaminants, the drainage area has already been washed by the initial flush of storm water. After this initial flush of storm water, the separator tank then experiences relatively high flow of water that is relatively free of contaminants. If the separator tank is too small, these high flows will remobilize the already separated contaminants. Again, the separator tanks must be designed to be large enough so that these peak high volumes and flow rate do not remobilize the contaminants.

The large size requirements for separator tanks limit their usefulness to treat liquids of variable or high flow. Many attempts have been made to reduce the size requirements of the separator tank.

Of note, U.S. Pat. No. 4,578,188 to Cousino teaches a method to allow low flow to fall into a separator tank or other disposal and high flow to jump across a gap. The gap is contained within a weir such that extremely high flow completely bypasses the gap. Presumably, the low flow will spill into the settlement tank along with its carried contaminants while the high flow has enough kinetic energy to continue on.

U.S. Pat. No. 4,985,148 to Monteith teaches a nearly identical and simplified method to achieve a similar result. Monteith dispenses with the gap but continues to use the weir, dumping all low flow into an integrated separator tank. As the separator tank fills, the separated water in the separator tank exits downstream of the weir. Monteith teaches a way to house the weir, separator tank, and return from separator tank all in a single container.

BRIEF SUMMARY OF THE INVENTION—OBJECTS AND ADVANTAGES

The present invention improves environmental control of waste water. The present invention provides a method of installing an environmental control system so as to allow for separate sizing of treatment and bypass capacity while also offering the ability to make or change either treatment or bypass capacities at different times. This is accomplished by containing the treatment and bypass functions in separate chambers, using screen, baffle, or coalescing media pack to further refine effectiveness and capacity of each structure independently. The control structure and interceptor structure may be pre-engineered to a variety of sizes, capacities, or other specifications. This allows simple selection of a specific control structure and a specific interceptor structure from a variety of combinations, eliminating the need for custom engineering for each installation.

While both teachings of Cousino and Monteith provide a way to limit the kinetic energy in the separator area while at the same time allowing high flow to bypass the separator tank altogether, their methods are both limited to a certain range of useful flow rates and contaminant load. It is an object of the present invention to expand the range of useful flow rates and contaminant loads as well as enable application of a greater diversity of separation techniques. As such, the present invention is more desirous and offers significant advantages over the prior art.

It is a further object of this invention to allow fluids to exit the control structure from the side independent of location of a treatment compartment, resulting in the ability to control the quality or ratio of separation for various flow rates.

An object as well as advantage is that different control structure size requirements over treatment interceptor structure sizes may be chosen. With the present invention, these sizes may be independently determined.

The features of the treatment interceptor structure and the specific separation means employed may be designed independently from the control structure.

Either control structure or treatment interceptor structure may be installed at different times, allowing retrofits to existing installations of either.

An advantage of the present invention is its ability to retrofit existing manholes.

The control structure may be designed to allow multiple connections to an array of inlet sources or treatment interceptor structures. The control structure can act as a stand-alone junction box.

The physical separation of control structure from treatment interceptor structure results in more predictable operation.

Independent sizing of the control structure may be guided by the customer's drainage pipe sizes, reflecting the anticipated maximum capacity of surge flow.

Independent sizing of the treatment interceptor structure and choice of filtering methods reflect the amount and type of anticipated waste pollutants needed to be captured.

A further object and advantage of the present invention is to introduce an environmental control system whereby the coalescing plate media do not have to be disassembled for their proper cleaning. With the present invention, the coalescing plate media are readily and effectively cleaned in situ.

A further object and advantage is to manufacture the control structure and interceptor structure to a variety of pre-engineered performance specifications. Customers are then able to select a combination of control structure and interceptor structure pairs without the need for custom engineering.

BRIEF DESCRIPTION OF THE SEVERAL VIEWS OF THE DRAWING

The present invention and its advantages will be better understood by referring to the following detailed description and the attached drawings in which:

FIG. 2 shows a 3-D perspective view of the treatment system;

FIG. 6 shows a side cross-sectional view of the control structure and interceptor structure in a typical arrangement;

REFERENCE NUMERALS IN DRAWINGS

| | |
|---|---|
| 20 treatment system | 22 surface drain structure |
| | 22' surface drain structure |
| 24 drain piping | 26 convergence drain pipe |
| 26a upstream convergence drain pipe | 26a' upstream convergence drain pipe |
| 26b downstream convergence drain pipe | |
| 28 control structure | 28' open ditch control structure |
| 30 upstream control chamber | 31 downstream control chamber |
| 32 control extension riser | 34 control access cover |
| 35 control debris screen | 36 treatment debris screen |
| 38 control partition | 38' control partition |
| 40 treatment water inlet pipe | 41 inlet cutoff valve |
| 40a control side treatment inlet pipe | |
| 40b interceptor side treatment inlet pipe | |
| 45 treatment water outlet pipe | 46 outlet cutoff valve |
| 45a control side treatment outlet pipe | |
| 45b interceptor side treatment outlet pipe | |
| 50 interceptor structure | 53 diffusion baffle |
| 55 upstream interceptor chamber | 58 downstream interceptor chamber |
| 60 interceptor partition | |
| 62 interceptor inlet pipe | 64 interceptor outlet pipe |
| 65 coalescing media pack | 67 media pack frame |
| 70 interceptor debris screen | |
| 75 interceptor extension riser | 77 interceptor access cover |

DETAILED DESCRIPTION OF THE INVENTION

Figure 1:
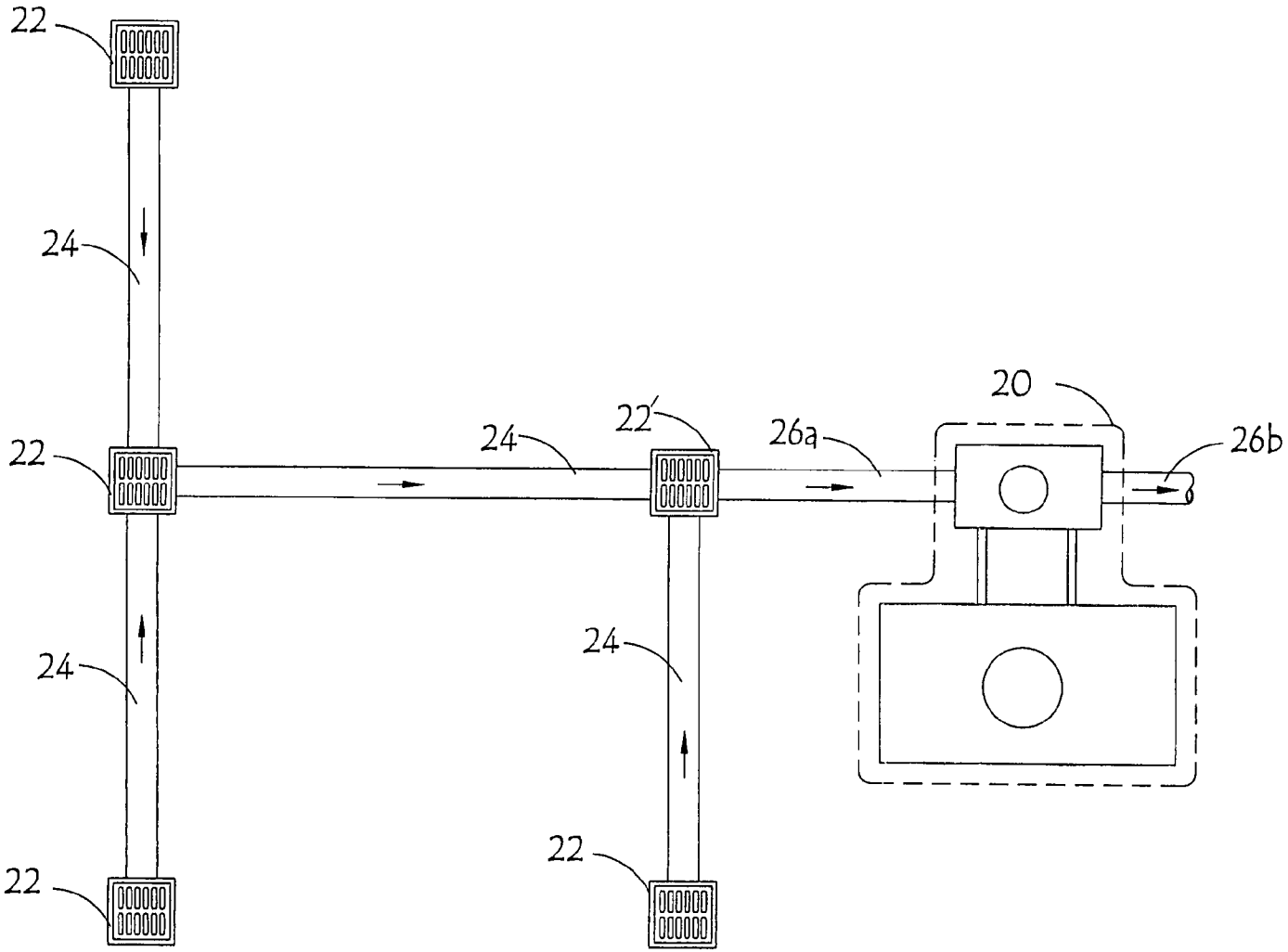
FIG. 1 shows a plan view showing the treatment system in the context of a typical application.

FIG. 1 shows a plan view showing the treatment system in the context of a typical application. Unprocessed fluids flow into one or more surface drain structures 22, which convey said unprocessed fluids to drain piping 24. A connection from a surface drain structure 22' is made to the upstream convergence drain pipe 26*a*, conveying said unprocessed fluids towards a treatment system 20. Treatment system 20 provides for varying degrees of separation of contaminants, depending upon the flow conditions, resulting in a conversion of unprocessed fluid to processed fluid. The processed fluid then exits treatment system 20 by way of downstream convergence drain pipe 26*b*.

FIG. 2 shows a 3-D perspective view of the treatment system in a typical embodiment. Unprocessed fluid travels in upstream convergence drain pipe 26*a*, which is connected to control structure 28. Unprocessed fluid enters control structure 28. Control extension riser 32 is attached to the topside of control structure 28, allowing access into control structure 28. Control access cover 34 rests upon and closes control extension riser 32. Control structure 28 is connected to interceptor structure 50 by way of treatment water inlet pipe 40. Fluids being processed are able to exit control structure 28 and enter interceptor structure 50 by way of treatment water inlet pipe 40. Interceptor extension riser 75 is attached to the topside of interceptor structure 50, allowing access into interceptor structure 50. Interceptor access cover 77 rests upon and closes interceptor extension riser 75. Interceptor structure 50 is connected to control structure 28 by way of treatment water outlet pipe 45. Fluids returning from interceptor structure 50 to control structure 28 are able to do by way of treatment water outlet pipe 45. Processed fluids are able to exit by way of downstream convergence drain pipe 26*b*, which is attached to control structure 28.

Figure 3:
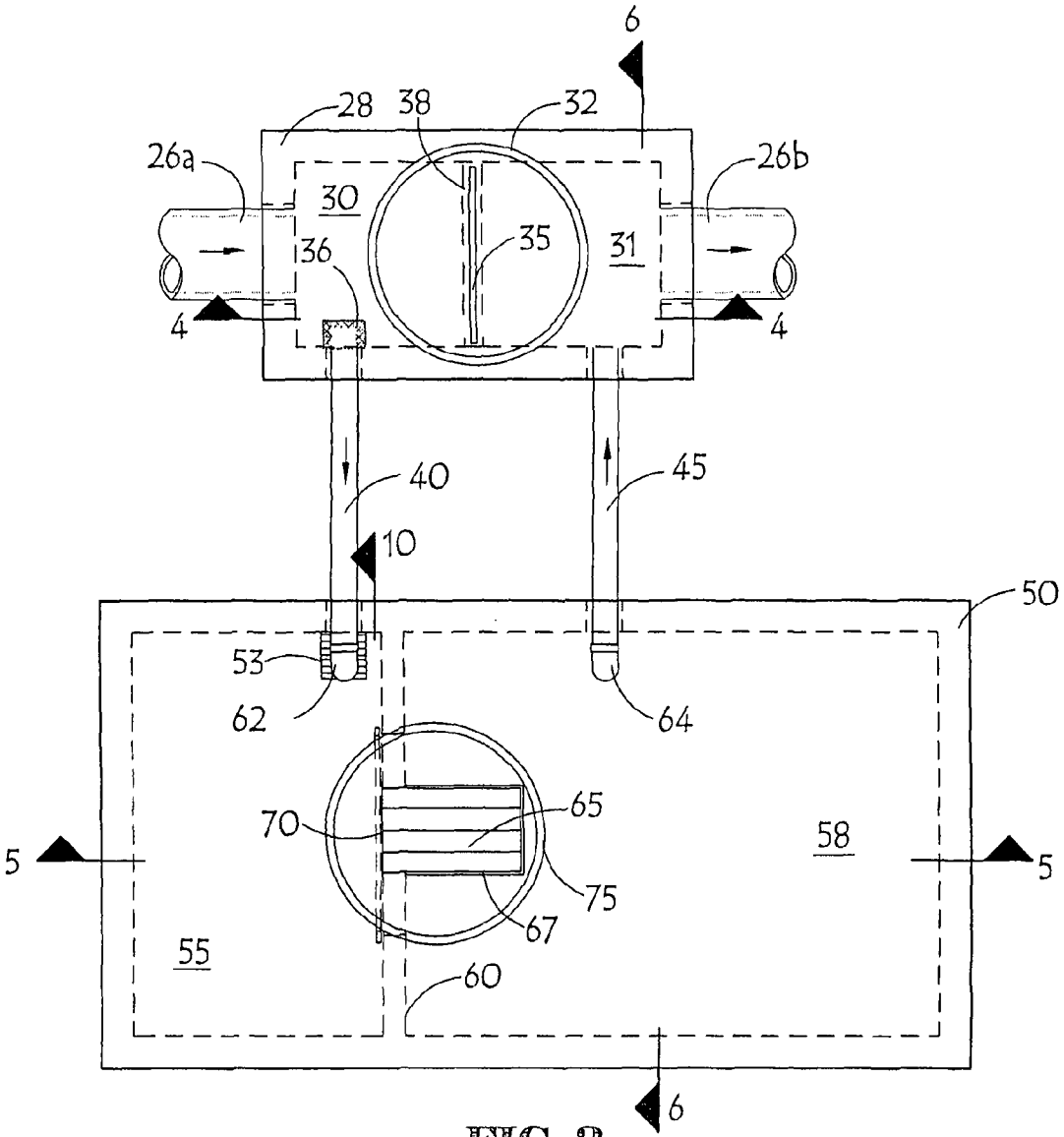
FIG. 3 shows a plan view of the treatment system.

FIG. 3 shows a plan view of the treatment system. Control partition 38 divides the interior of control structure 28 into two chambers, upstream control chamber 30 and downstream control chamber 31. Upstream convergence drain pipe 26*a* enters that portion of control structure 28 comprising upstream control chamber 30. A first end of treatment water inlet pipe 40 exits that portion of control structure 28 comprising upstream control chamber 30. A treatment debris screen 36 may be applied across the first end of treatment water inlet pipe 40. An inlet cutoff valve 41 may be inserted in the flow path of treatment water inlet pipe 40, as will be illustrated in FIG. 8.

Interceptor partition 60 generally divides the interior of interceptor structure 50 into two chambers, upstream interceptor chamber 55 and downstream interceptor chamber 58. Treatment water inlet pipe 40 enters that portion of interceptor structure 50 comprising upstream interceptor chamber 55. The second end of treatment water inlet pipe 40 attaches to a first end of interceptor inlet pipe 62, which bends downward into upstream interceptor chamber 55. The second end of interceptor inlet pipe 62 opens into upstream interceptor chamber 55. Liquids held within upstream interceptor chamber 55 communicate via an opening in interceptor partition 60. Interceptor debris screen 70 covers said opening in interceptor partition 60. Media pack frame 67 is affixed to interceptor structure 50, preferably affixed to the interceptor partition 60, downstream of interceptor debris screen 70 and preferably contained within downstream interceptor chamber 58.

Coalescing media pack 65 is placed into media pack frame 67. In the preferred embodiment, coalescing media pack 65 is comprised of multiple plates stacked in a horizontal fashion, at a spacing typically approximately one-quarter to one-half inch. The plates have bi-directional corrugations forming crests and valleys in two directions. The crests and valleys include bleed holes for passage there through of immiscible components mixed with the fluid undergoing treatment. The bi-directional corrugations are approximately orthogonal to one another and approximately sinusoidal. Generally, the wavelength of the corrugations in one direction is greater than the wavelength of corrugations in the other direction, and it is preferred that the direction of flow be parallel to the corrugations formed by the longer wavelengths. Such coalescing media plates are available from Facet International of Tulsa, Okla. under the trademark of Mpak® coalescing plates.

A first end of interceptor outlet pipe 64 opens into downstream interceptor chamber 58. The second end of interceptor outlet pipe 64 bends outward and attaches to one end of treatment water outlet pipe 45. An outlet cutoff valve 46 may be inserted in the flow path of treatment water outlet pipe 45, as will be illustrated in FIG. 8. Treatment water outlet pipe 45 enters that portion of control structure 28 comprising downstream control chamber 31. Downstream convergence drain pipe 26*b* exits that portion of control structure 28 comprising downstream control chamber 31.

Figure 4:
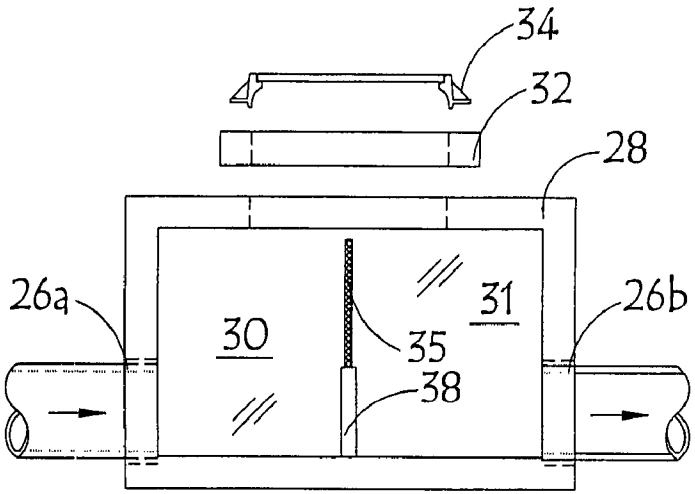
FIG. 4 shows a side cross-sectional view of the control structure.

FIG. 4 shows a side cross-sectional view of the control structure 28. Upstream convergence drain pipe 26*a* enters that portion of control structure 28 comprising upstream control chamber 30. Control partition 38 extends upward from the base of the interior of control structure 28, generally segregating upstream control chamber 30 from downstream control chamber 31. Control debris screen 35 further segregates upstream control chamber 30 from downstream control chamber 31. Downstream convergence drain pipe 26*b* exits that portion of control structure 28 comprising downstream control chamber 31. Control extension riser 32 is attached to the topside of control structure 28, allowing access into control structure 28. Control access cover 34 rests upon and closes control extension riser 32.

Figure 5:
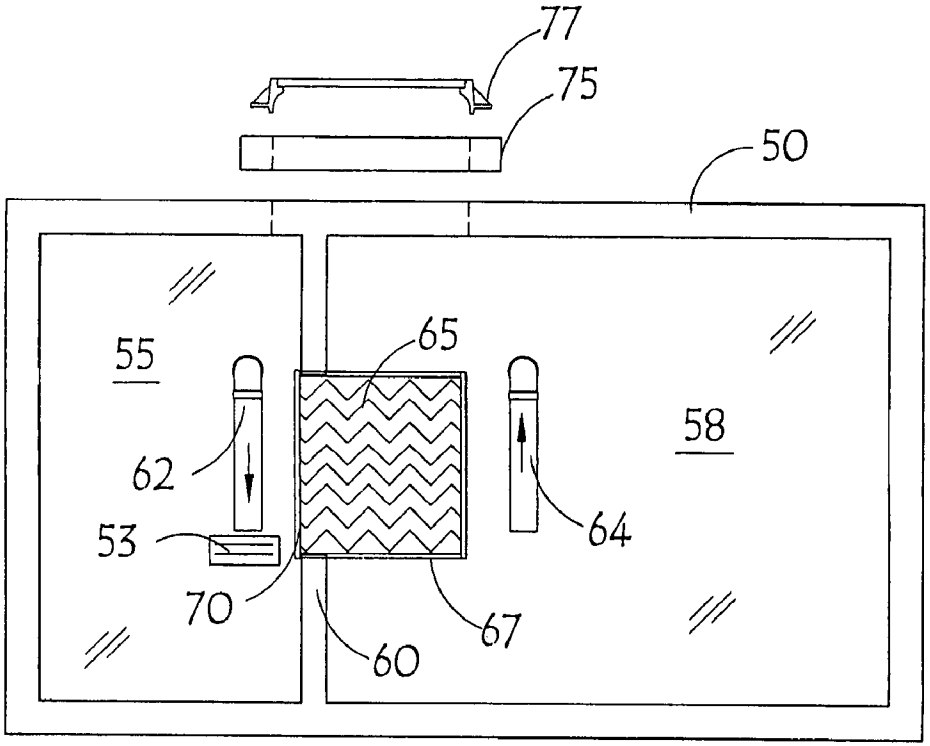
FIG. 5 shows a side cross-sectional view of the interceptor structure.

FIG. 5 shows a side cross-sectional view of interceptor structure 50. Interceptor partition 60 divides the interior of interceptor structure 50 into two chambers, upstream interceptor chamber 55 and downstream interceptor chamber 58. Interceptor inlet pipe 62 bends downward into upstream interceptor chamber 55. Diffusion baffle 53 is attached to interceptor structure 50 beneath the opening of interceptor inlet pipe 62. Liquids held within upstream interceptor chamber 55 communicate via an opening in interceptor partition 60. Interceptor debris screen 70 covers said opening in interceptor partition 60. Media pack frame 67 is affixed to interceptor structure 50, preferably affixed to the interceptor partition 60, downstream of interceptor debris screen 70 and preferably contained within downstream interceptor chamber 58 Coalescing media pack 65 is placed into media pack frame 67. Interceptor outlet pipe 64 bends downward into downstream interceptor chamber 58. Interceptor extension riser 75 is attached to the topside of interceptor structure 50, allowing access into interceptor structure 50. Interceptor access cover 77 rests upon and closes interceptor extension riser 75.

Coalescing media pack 65 is preferably installed so as to allow for in situ cleaning. This is accomplished by placing the bleed holes of coalescing media pack 65 generally upright so as to allow for ease of access from interceptor extension riser 75.

FIG. 6 shows a side cross-sectional view of the control structure 28 and interceptor structure 50 in a typical arrangement.

Figure 7:
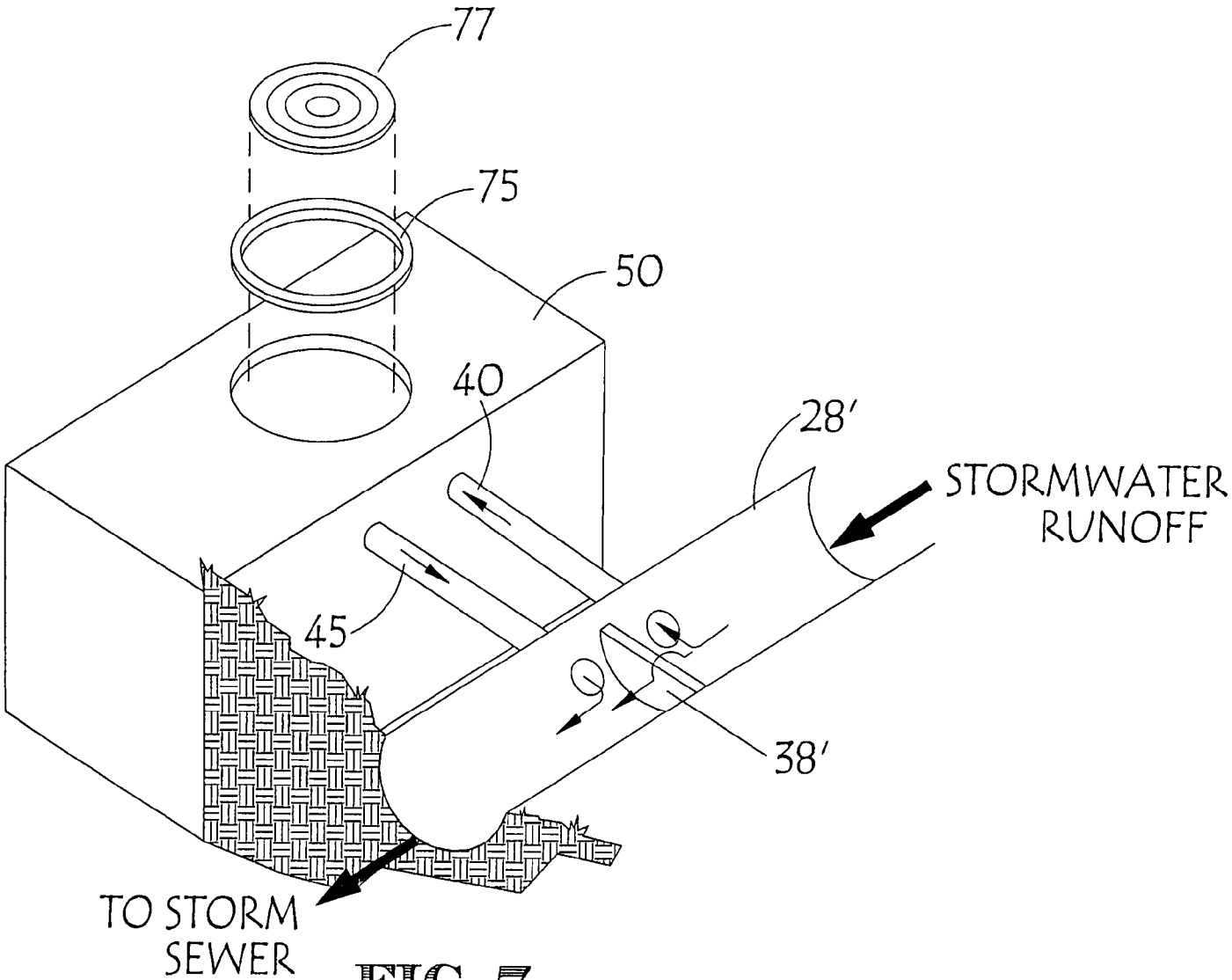
FIG. 7 shows a perspective view of an alternate embodiment using an open ditch control structure 28'.
Figure 8:
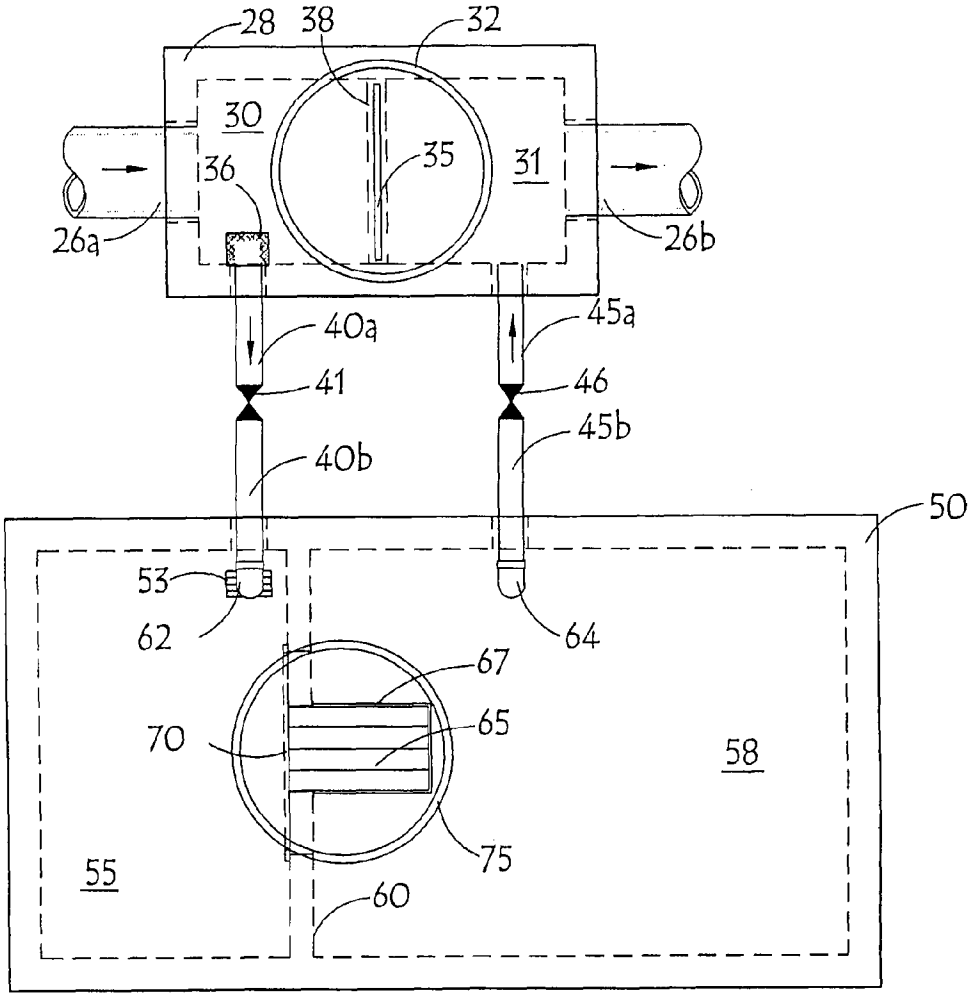
Figure 9:
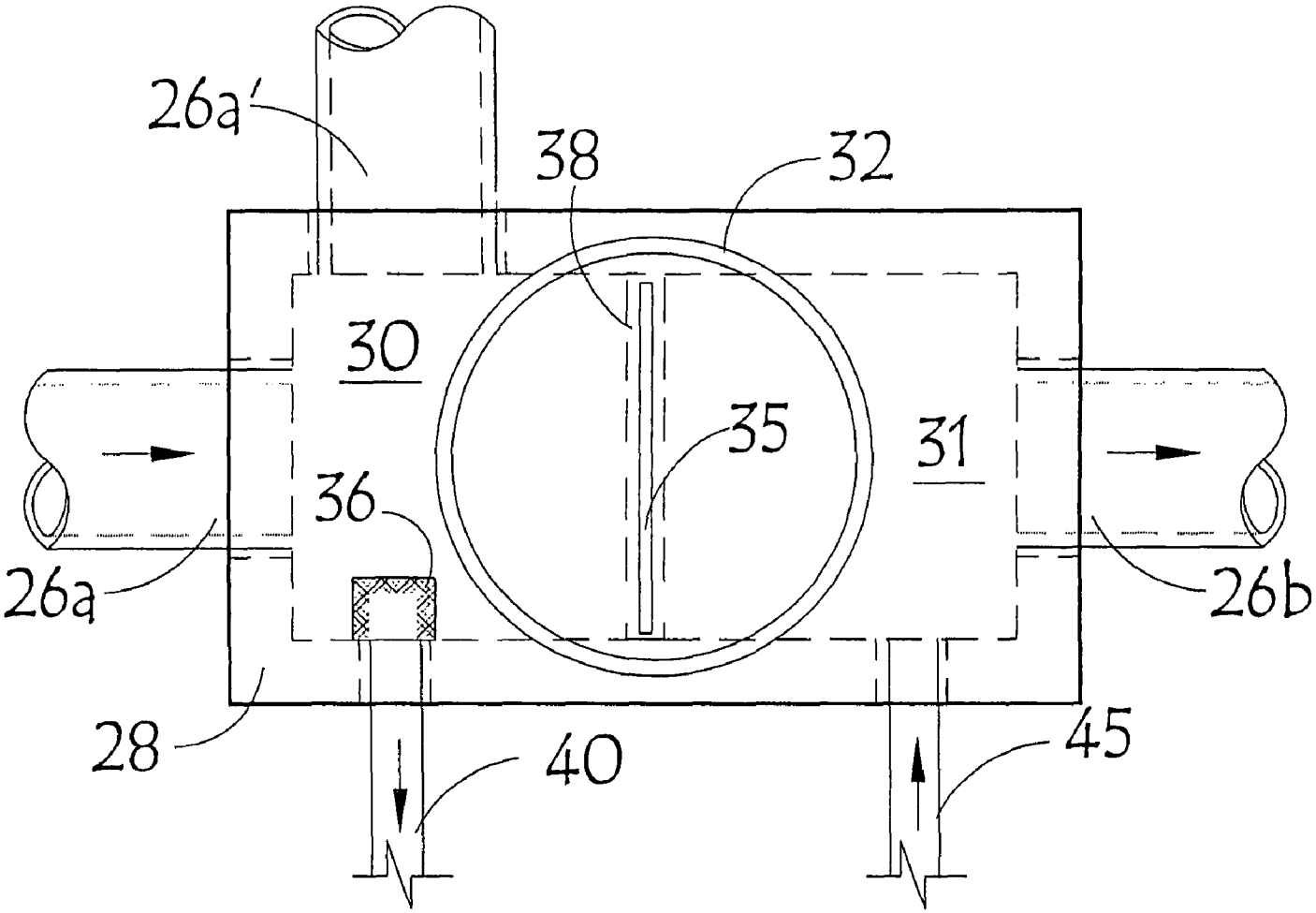

FIG. 7 shows a perspective view of an alternate embodiment using an open ditch control structure 28'. Open ditch control structure 28' is generally upwardly open and relatively narrow along the axis that is perpendicular to flow. Flow is partially interrupted by control partition 38', acting to divert at least some flow to treatment water inlet pipe 40. Flow from treatment water inlet pipe 40 enters interceptor structure 50. Treated fluids return from interceptor structure 50 by way of treatment water outlet pipe 45. Treatment water outlet pipe 45 enters open ditch control structure 28' downstream from control partition 38'.

Figure 8:
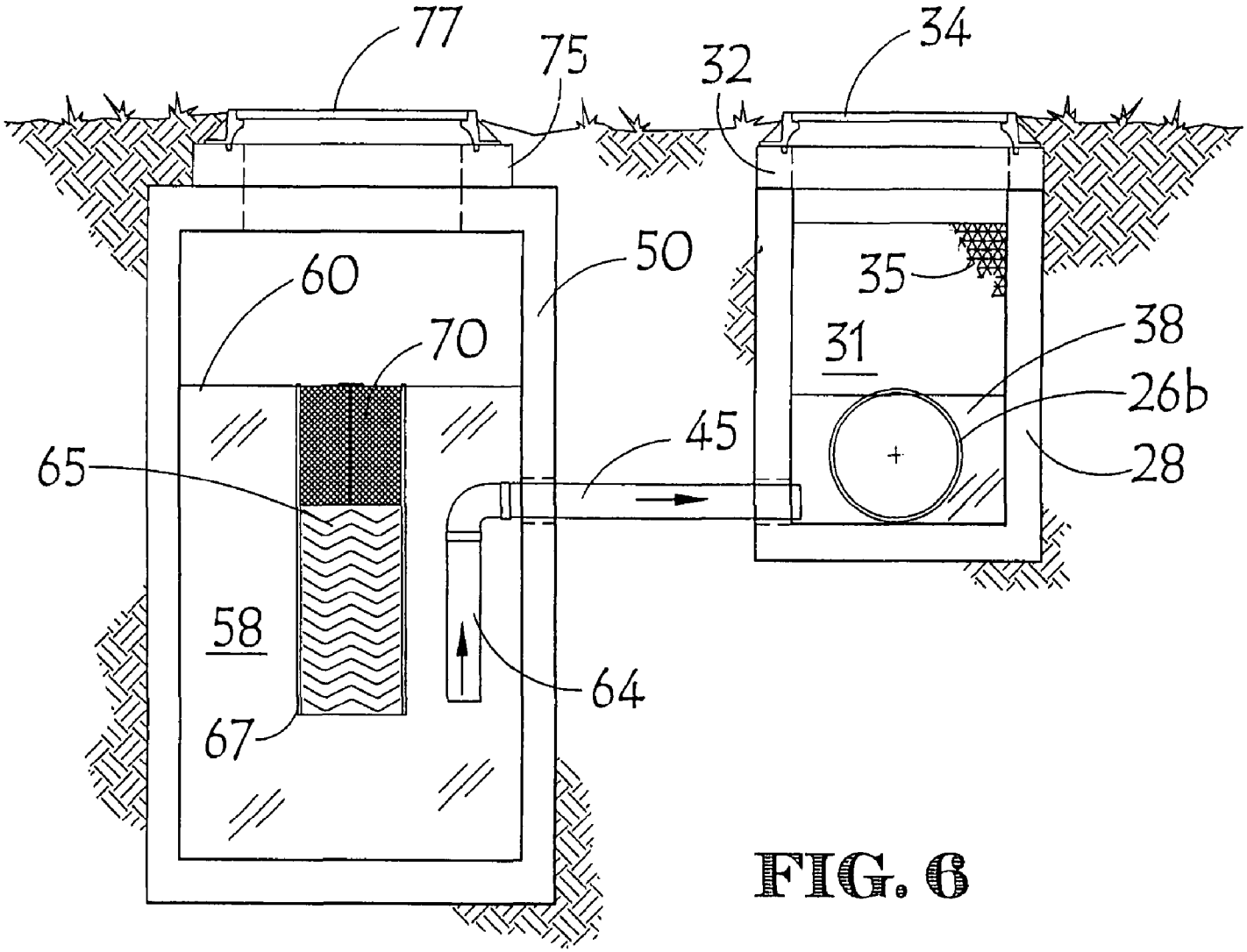
FIG. 8 shows a plan view of an alternate embodiment of the treatment system.

FIG. 8 shows a plan view of an alternate embodiment of the treatment system. The treatment water inlet pipe 40 of FIG. 3 may be replaced with a control side treatment inlet pipe 40*a*, inlet cutoff valve 41, and interceptor side treatment inlet pipe 40*b*. A first end of control side treatment inlet pipe 40*a* exits that portion of control structure 28 comprising upstream control chamber 30. The second end of control side treatment inlet pipe 40*a* connects to inlet cutoff valve 41. Inlet cutoff valve 41 connects to a first end of interceptor side treatment inlet pipe 40*b*. The second end of interceptor side treatment inlet pipe 40*b* attaches to a first end of interceptor inlet pipe 62. The treatment water outlet pipe 45 of FIG. 3 may be replaced with a control side treatment outlet pipe 45*a*, outlet cutoff valve 46, and interceptor side treatment outlet pipe 45*b*. A first end of control side treatment outlet pipe 45*a* exits that portion of control structure 28 comprising downstream control chamber 31. The second end of control side treatment outlet pipe 45*a* connects to outlet cutoff valve 46. Outlet cutoff valve 46 connects to a first end of interceptor side treatment outlet pipe 45*b*. The second end of interceptor side treatment outlet pipe 45*b* attaches to a first end of interceptor outlet pipe 64.

Figure 9:
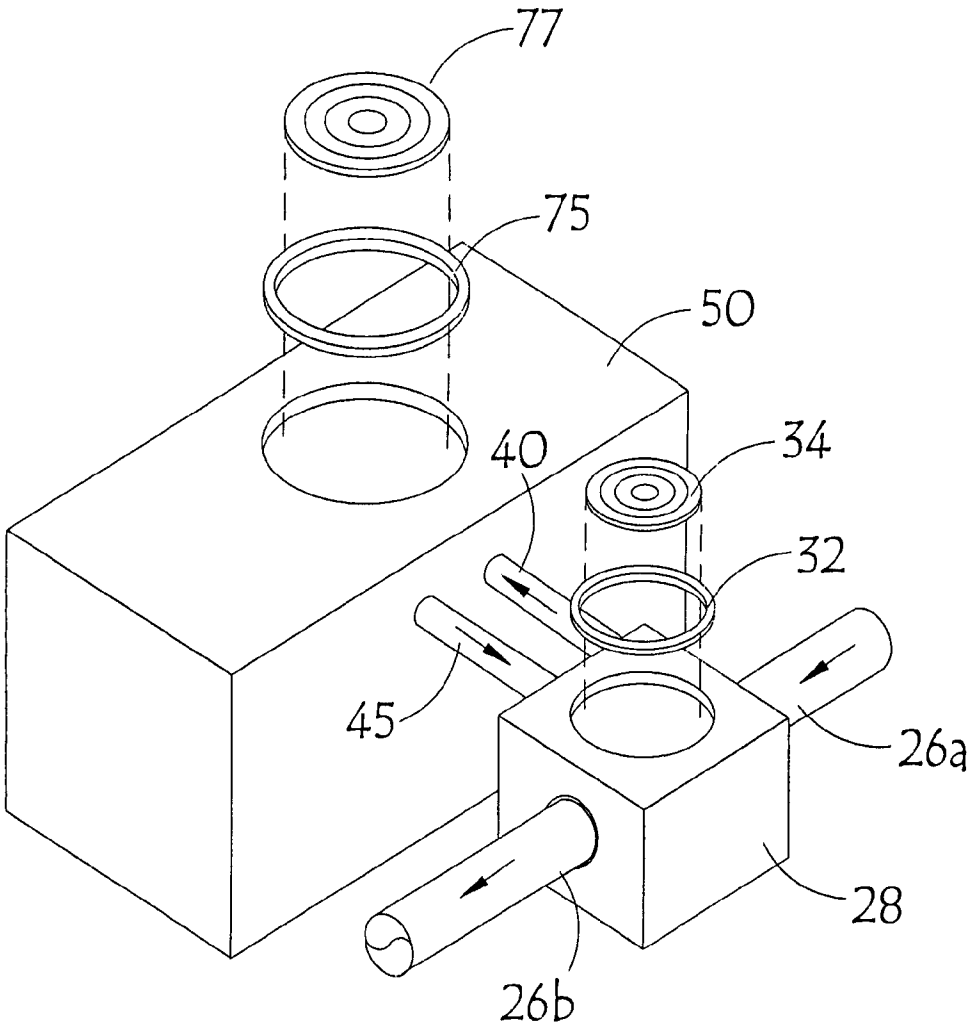
FIG. 9 shows a plan view of an alternate embodiment of control structure 28.

FIG. 9 shows a plan view of an alternate embodiment of control structure 28. Multiple upstream convergence drain pipes 26*a*, 26*a*' may enter the upstream control chamber 30 of control structure 28. Control structure 28 can act as a standalone junction box.

In an alternate embodiment, a surface grate positioned over the top of upstream control chamber 30 replaces, or is placed in addition to, upstream convergence drain pipe 26*a*. Fluids washing from the surface fall through the surface grate, into upstream control chamber 30 for further processing.

Figure 10:
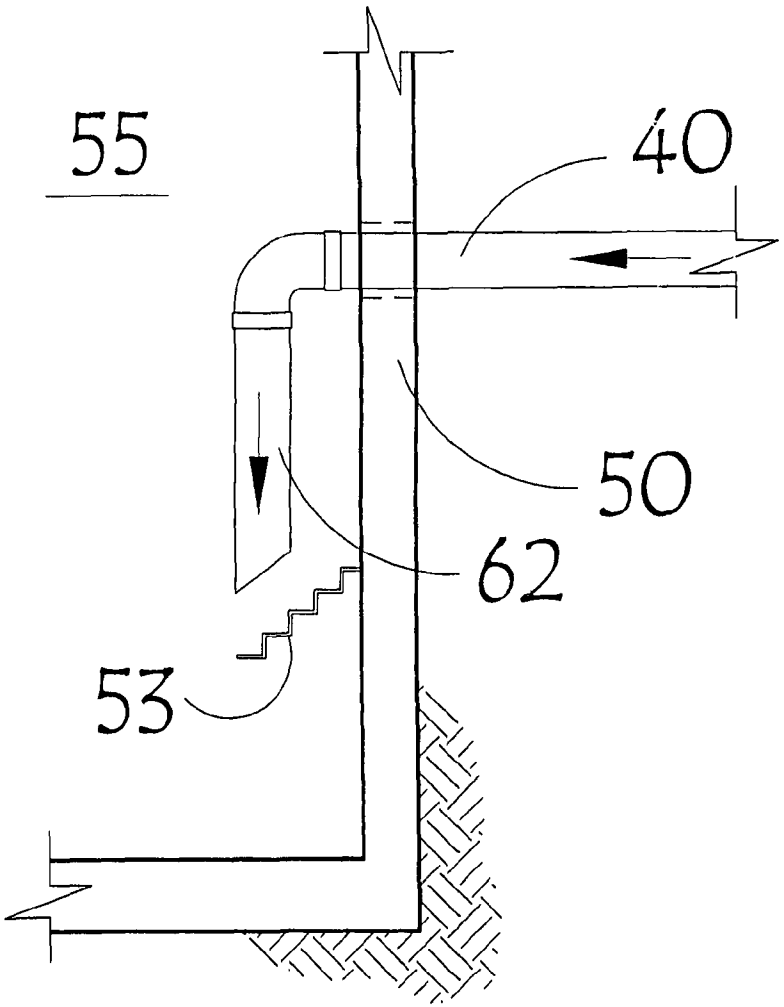
FIG. 10 shows a partial cross section view of interceptor structure 50, detailing an alternate embodiment of diffusion baffle 53.

FIG. 10 shows a partial cross section view of interceptor structure 50, detailing an alternate embodiment of diffusion baffle 53. Diffusion baffle 53 is shaped so as to form a stairstep pattern of alternating generally horizontal and generally vertical panels. In practice, the horizontal and vertical panels are at approximately ninety-degree angles with respect to each other. The average slope of the resulting surface is approximately forty-five degrees. The second end of interceptor inlet pipe 62 may be cut at an angle to approximately match the average slope of the resulting surface. The relative angle between horizontal and vertical panels is not critical and further alternate embodiments using angles other than ninety-degrees are possible. Likewise, the average slope of the resulting surface may be adjusted to effect a desired amount of flow dispersion.

DETAILED DESCRIPTION OF THE INVENTION—OPERATION

The present invention is a method of installing an environmental control system so as to allow for separate sizing of treatment and bypass capacity while also offering the ability to make or change either treatment or bypass capacities at different times. This is accomplished by containing the treatment and bypass functions in separate chambers, using screen, baffle, or coalescing media pack to further refine effectiveness and capacity of each structure independently.

The control structure and interceptor structure may be pre-engineered to a variety of sizes, capacities, or other specifications. This allows simple selection of a specific control structure and a specific interceptor structure from a variety of combinations, eliminating the need for custom engineering for each installation.

In typical operation, storm water flows into control structure 28 by way of upstream convergence pipe 26*a*. Control partition 38 retains the storm water and its associated debris generally in upstream control chamber 30. Storm water exits upstream control chamber 30 by way of treatment water inlet pipe 40. A treatment debris screen 36 may be used to prevent debris from entering treatment water inlet pipe 40. Fluid levels inside upstream control chamber 30 rise when incoming flow exceeds the capacity of treatment water inlet pipe 40 to drain upstream control chamber 30. Should upstream control chamber 30 fill across control partition 38, fluids in that event will exit upstream control chamber 30 and enter into downstream control chamber 31. Control debris screen 35 retains debris in upstream control chamber 30, preventing debris from entering downstream control chamber 31.

Fluids from treatment water inlet pipe 40 enter upstream interceptor chamber 55 via interceptor inlet pipe 62. Diffusion baffle 53 disperses the flow from interceptor inlet pipe 62 to reduce the velocity of the entering fluids, thereby reducing the amount of disturbance of contaminants contained in upstream interceptor chamber 55. Interceptor inlet pipe 62 is positioned so as to expel entering fluids towards the lower portion of upstream interceptor chamber 55, allowing less dense fluids, such as oils, to separate towards the upper portion of upstream interceptor chamber 55. Debris tend to settle towards the lower portion of upstream interceptor chamber 55. Interceptor debris screen 70 is positioned above the lowest portion of upstream interceptor chamber 55 and the highest portion of upstream interceptor chamber 55, preventing debris from passing from upstream interceptor chamber 55 to downstream interceptor chamber 58. Coalescing media pack 65 is positioned downstream of interceptor debris screen 70 and generally within downstream interceptor chamber 58, receiving fluids passing from upstream interceptor chamber 55 to downstream interceptor chamber 58. Coalescing media pack 65 generally removes additional oils from the water and also further disperses the flow to reduce flow velocity, creating a fluid environment relatively more quiet than that experienced in upstream interceptor chamber 55. Interceptor outlet pipe 64 opens towards the lower portion of downstream interceptor chamber 58, where fluids tend to be free of debris and oils. Interceptor outlet pipe 64 rises towards and connects to treatment water outlet pipe 45. Treated fluids flow into interceptor outlet pipe 64 and out of interceptor structure 50 by way of treatment water outlet pipe 45. Treatment water outlet pipe 45 enters control structure 28 into downstream control chamber 31, which is downstream from control partition 38. Fluids entering the downstream side of control partition 38, from either treatment water outlet pipe 45 or from upstream control chamber 30, exit control structure 28 by way of downstream convergence drain pipe 26*b*. Control partition 38 generally prevents treated fluids from back flowing into upstream control chamber 30.

Maintenance and cleaning of control structure 28 is accomplished by entering via control access cover 34 and control extension riser 32. Debris may be removed from either upstream control chamber 30 or downstream control chamber 31. Maintenance and cleaning of interceptor structure 50 is accomplished by entering via interceptor access cover 77 and interceptor extension riser 75. Debris, oils, or other contaminants may be removed from either upstream interceptor chamber 55 or downstream interceptor chamber 58. Coalescing media pack 65 may be cleaned by introducing a nozzle through the bleed holes of coalescing media pack 65.

In alternate embodiments, the present invention offers flexibility by choosing the type of control structure used. The control structure can take the form of a typical control manhole, an open ditch containing a weir, a pumped method, or by modifying other existing structures. Elimination of the use of the control structure offers total treatment of all stormwater.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

Thus, the scope of the invention should be determined by the appended claims and their legal equivalents, rather than by the examples given.

What I claim as my invention is:

1. A method for pre-engineering a system for environmental control of storm water, comprising:

providing a selection of control structure members having various flow capacities, wherein the selection comprises a control structure member comprising:

a housing containing an upstream control chamber and a downstream control chamber separated by a partition, a first opening into the upstream control chamber for receiving an inlet pipe, a second opening into the downstream control chamber for receiving an outlet pipe, an exit from the upstream control chamber for connecting a first pipe, and an entrance into the downstream control chamber for connecting a second pipe;

providing a selection of interceptor structure members having various treatment capacities wherein the selection comprises an interceptor structure member comprising a housing containing an upstream interceptor chamber and a downstream interceptor chamber, whereby a combination of various pairs of said control structure members and said interceptor structure members becomes available;

selecting a control structure member and selecting an interceptor structure member from said combination of pairs;

installing said selected control structure member;

installing said selected interceptor structure member;

connecting the first pipe between the upstream control chamber of the selected control structure member and the upstream interceptor chamber of the selected interceptor structure member; and connecting the second pipe between the downstream control chamber of the selected control structure member and the downstream interceptor chamber of the selected interceptor structure member, whereby passage of fluids from the upstream control chamber of the selected control structure member to the downstream control chamber of the selected control structure member by way of the selected interceptor structure member is enabled.

* * * * *